US008376123B2

(12) United States Patent
Stauber et al.

(10) Patent No.: US 8,376,123 B2
(45) Date of Patent: Feb. 19, 2013

(54) DEVICE AND METHOD FOR OPENING PRINTED PRODUCTS

(75) Inventors: Erwin Stauber, Gruet (CH); Marc-Andreas Benz, Gruet (CH)

(73) Assignee: Ferag AG, Hinwil (CH)

( * ) Notice: Subject to any disclaimer, the term of this patent is extended or adjusted under 35 U.S.C. 154(b) by 105 days.

(21) Appl. No.: 13/117,280

(22) Filed: May 27, 2011

(65) Prior Publication Data

US 2011/0290618 A1 Dec. 1, 2011

(30) Foreign Application Priority Data

May 31, 2010 (CH) ..... 0856/10

(51) Int. Cl.
*B65G 47/22* (2006.01)

(52) U.S. Cl. ..... 198/493; 198/459.3; 270/52.23

(58) Field of Classification Search ..... 198/493, 198/459.3; 271/175, 204, 179, 246, 247, 271/277; 270/52.23, 52.27
See application file for complete search history.

(56) References Cited

U.S. PATENT DOCUMENTS 5,112,036 A * 5/1992 Hatt ..... 270/52.23
5,443,250 A * 8/1995 Gosslinghoff ..... 270/52.23
5,462,266 A 10/1995 Meier
5,474,286 A 12/1995 Reist
6,017,027 A * 1/2000 Jaeger ..... 270/52.23
6,375,179 B1 * 4/2002 Boss et al. ..... 270/52.27
7,198,146 B2 * 4/2007 Guidetti ..... 198/493

FOREIGN PATENT DOCUMENTS

EP 0577964 B1 1/1994
EP 0596581 A2 5/1994
EP 0647582 A1 4/1995
EP 1090867 A2 4/2001
EP 1908714 A1 4/2008

* cited by examiner

*Primary Examiner* — James R Bidwell
(74) *Attorney, Agent, or Firm* — Rankin, Hill & Clark LLP

(57) ABSTRACT

A device for opening and further transporting of printed products with respectively at least two sheets held together over a fixed edge, including a conveying device with transport grippers driven in conveying direction (F) arranged with a distance between one another, which are designed to hold the printed products suspended on their fixed edge, as well as with an opening device arranged below the transport grippers, which is destined to open the printed products. The opening device includes an opening wedge capable of being inserted into a free edge zone between the sheets of the printed product, and the opening device furthermore includes a device for supplying blast air, by way of which the sheets of the printed product are capable of being fanned open in the edge zone, into which the opening wedge is inserted.

14 Claims, 5 Drawing Sheets

DEVICE AND METHOD FOR OPENING PRINTED PRODUCTS

BACKGROUND OF THE INVENTION

1. Field of the Invention

The invention is related to a method and a device for opening and transporting on printed products with respectively at least two sheets held together over a fixed edge, comprising a conveying device with transport grippers arranged behind one another at a distance from one another and driven in a conveying direction (F), which are designed to hold the printed products at their fixed edge, as well as comprising opening devices arranged underneath the conveying device, which are meant to open the printed products, wherein the opening device comprises gas supply means for producing a gas flow, by means of which the sheets of the printed product are capable of being fanned open in a free edge zone, and an opening element introducible into the fanned open free edge zone.

2. Description of Related Art

Printed products with several sheets, which are held together over a fixed edge, for the execution of certain processing steps have to be opened. Thus, for example, the printed products for inserting objects between two product parts of a folded or bound printed product have to be opened. In another application, printed products have to be opened, in order for these to be able to be placed on a saddle, so that the opened and placed on saddle printed products are capable of being brought to a collecting device. Furthermore, the opening of a printed product is also necessary, when an object is to be stuck on to a side of a sheet located inside, or when a side of a sheet located inside has to be printed on.

From EP 0 647 582 A1 it is known that printed products to be opened are held at their fixed edge and transported essentially in vertically suspended position, wherein the front edge zone opposite the fixed edge is supported by a supporting element. A suction head as an opening element is inserted between the printed products from above the supporting element and from above grips in between the printed products and lies against these, while a further suction head lies against the printed product from below. As a result, the product parts are held on both sides during the complete opening process. The device is designed to open folded individual sheets, or to open doubly folded products, which are folded a first time and then a second time at right angles to the first fold. The doubly folded product must not be cut, in order for it to be able to be reliably opened. The opened printed product subsequently with its opened edge zone is transferred to a helical holding open device.

EP 1 908 714 B1, in contrast, describes an opening device with a wedge element, by means of which the opening of a folded document is possible while it is being conveyed.

EP 1 090 867 B1 describes a device for opening folded printed products with a pre-fold, wherein the printed products for this purpose are inserted into bags and with mechanical means, such as clamping stops, hooking elements as well as a pressure rail with gripper hooks are opened. This device, however, only works for two-page printed products with a positive overlap.

EP-B-0 577 964, in turn, describes a device and a method for opening multi-page printed products. The printed products at a free edge are subjected to a gas flow, which leads to a fanning open of the sheets in this edge zone. Subsequently an opening element is inserted into the fanned open edge zone, which opens the product for the further processing. For a controlled fanning open of the printed product the printed product in accordance with a specific embodiment is inserted into a receiving cell with side walls. In doing so, the side walls serve to limit the fanning open, which as a result becomes more uniform.

For reasons of processing efficiency, for example, printed products conveyed one behind the other shall be opened during the uninterrupted conveyance. For this reason, it is disadvantageous in a continuous conveying process, if the printed products for being opened have to be brought to individual receiving cells. An opening method of this kind therefore during the conveyance of the printed products only works, when the conveying direction of the printed products runs in parallel to the main plane of the sheets, as this is also indicated in EP-B-0 577 964.

BRIEF SUMMARY OF THE INVENTION

It is the object of the present invention to propose a device for opening a printed product with two or more sheets, the functioning of which is not dependent on the presence of a pre-fold on the printed product. The device therefore in particular shall be utilisable for a greater variety of printed products, in particular also for multi-sheet, cut printed products. Furthermore, the device and the method shall also be designed for printed products, the conveying direction of which is not parallel to the main plane of the sheets, and in particular essentially is orthogonal to the main plane of the sheets. The device and the method furthermore shall be utilisable independent of the further processing steps.

This object is achieved by a method and a device for opening printed products with the features of the corresponding independent claims.

The printed products to be opened are multi-sheet, wherein the individual sheets are held together over a fixed edge of the printed product. It is possible that the type of the connection of the sheets at the fixed edge of the printed product is temporary or permanent. Thus the sheets may be loose at the fixed edge of the printed product, i.e., arranged separated from one another, e.g., as a stack and exclusively held together with a temporary holding means. It is also possible, however, for the sheets to be held together at the fixed edge by a fold, a binding (e.g., ring binding), an adhesive joint or stitching. The fixed edge of the printed product may correspondingly also form a back, across which the sheets are held together at the fixed edge. It is also possible for the holding means to be, e.g., a clamp. The clamp may, e.g., be formed by the transport holder itself, which in this case preferably is a gripper. The sheets of the printed product as a rule are cut at their three page edges. If the sheets respectively are held together through a fold at the fixed edge, then the fixed edge is formed by a so-called bond. The printed product optionally may comprise a pre-fold. The invention, however, in particular is characterised by the fact that the opening process is also possible without a positive overlap.

The sheets preferably are individual pages of the printed product. The printed product apart from the fixed edge preferably comprises three free edge zones. Meant by "free edge zone" is an edge zone of the printed product, which is neither held nor completely closed and which at least comprises two sheets separatable from one another. In preference, all sheets of the printed product are loose in this edge zone and are not connected together, so that they, with the formation of a gap, at least partially are capable of being separated from one another.

It is also possible, that apart from the fixed edge another edge zone is provided, which is completely or partially closed, i.e, in case of which individual or else all sheets, e.g., are held together by a fold.

The printed product may, e.g., be present in tabloid format. In principle the device and the method are also suitable for opening documents, books, or other printed products.

The printed products are conducted to the opening device by means of a conveying device driven in conveying direction F with transport grippers arranged at a distance between one another. For this purpose the transport grippers hold the printed products at their fixed edges. The printed products are held and conveyed in a suspended position, in particular in a vertical suspended position. The fixed edge zone of the conveyed printed products in preference extends transverse or at an angle to the conveying direction F. The actual conveying of the printed products therefore takes place by the transport grippers holding the printed products at the fixed edge. The transport grippers are preferably driven on a transport chain along a predefined guide track. A transport gripper may take up one or several printed products. If the transport gripper takes up several printed products, then these preferably are arranged on the transport gripper offset to one another, so that they are able to be easily separated and subsequently individually opened at the offset point. The opening device in this case correspondingly comprises several opening elements. The printed products in doing so suitably are arranged offset to one another along that edge zone, which is not guided in the opening channel.

The opening device comprises an opening element capable of being introduced between the sheets in a free edge zone. The opening element preferably is situated in an opening wedge with a front edge formed by a narrowing. The opening wedge is also called opening knife. By the introduction of the opening element between the sheets of the printed product, the printed product is opened. In doing so, the printed product is separated into two product parts. Each product part comprises at least one sheet. In preference the product parts respectively comprise a plurality of sheets.

For assisting the above mentioned opening process, means for the production of a gas flow are provided. The gas flow preferably extends in parallel or essentially in parallel to the main planes of the sheets and produces a ram pressure at that free edge of the printed product, at which the opening element is introduced. By this ram pressure the sheets are separated from one another, wherein air flows into the spaces produced between the sheets, wherein the sheets are held stable in this position for as long as the air flow takes effect. The individual therefore are spread apart, resp., fanned open by the formation of air flows between the sheets, which in this application is designated as fanning open. The gas flow may also be conducted at an angle to the main plane of the sheets, it is, however, always aligned in such a manner, that it is in a position to produce the mentioned ram pressure, which causes the fanning open of the printed product.

The fanning open takes place at that free edge zone, at which the gas flow has a direct effect and if so required also at the bordering edge zone. The gas in preference is air. An air flow of this kind, for example, may be produced by means of compressed air, which, e.g., is brought into the opening channel from a compressed air reservoir, which assures a corresponding supply pressure, through compressed air pipes and outlet openings. The gas flow may also be produced by corresponding ventilators. The gas-, resp., air flow acting on the printed products is also designated as blast air.

The gas flow, e.g., is able to be conducted to a first or second, respectively departing from the fixed edge free sheet edge zone or from a free front sheet edge zone opposite the fixed edge, also called flower. The gas flow may be directed against one or several of the mentioned free edge zones. Furthermore, the gas flow may be produced over the whole length of an edge zone, over a section length of an edge zone or also only by spot, this signifies very locally, at a certain point of the edge zone. In principle the gas flow may also be conducted to a section of the fixed edge zone, which is not fixed by a holding means, this providing the fixed edge zone comprises at least two sheets separatable from one another. The mentioned edge zones, to which a gas flow is conducted for fanning open, in doing so are conducted in an opening channel.

The outlet openings in the opening device, which produce a gas flow in the direction of the edge zone, may be slot-shaped or point-shaped, e.g., as round openings by bores. Furthermore, a plurality of point-shaped openings, resp., bores may also be arranged in lines next to one another. Thus it is possible, e.g., that one or several rows of holes are provided along the channel bottom. In the channel bottom also a continuous in the longitudinal direction of the channel or an opening slot with interruptions may be provided.

It goes without saying that the gas flow in preference is directed to that point or to the vicinity of that point between the sheets, at which the opening element is introduced.

The printed product in the opening channel is not only fanned open and opened, but rather also conducted and positioned with its free edge zone.

Te opening device comprises means for the production of a gas flow, resp., for the supplying of blast air into the opening channel, which have the effect, that the free edge zone conducted in opening channel is fanned open by the supply of blast air. As already mentioned earlier, the fanning open takes place by the flowing in of blast air between the sheets, wherein in this case the edge zone conducted in the opening channel is fanned open in preference over the whole width of the opening channel. The opening element now in preference is designed and arranged in such a manner, that it is able to be introduced between the sheets into the edge zone of the printed product conducted in the opening channel and fanned open. It may also be provided, that the opening channel is introduced between the sheets outside the opening channel, still, however, within the zone of action of the gas flow. As already mentioned, the opening element introduced between the sheets opens the printed product, in that it separates the sheets at least into a first and a second product part at a distance from one another.

The opening channel preferably comprises two lateral channel walls with a space between them. Between the channel walls towards the axis of rotation a channel bottom may be arranged. The channel width defined by the channel walls in preference determines the width of the fanning open of the free edge zone conducted in the opening channel. The gas flow here preferably is conducted through openings in the channel bottom. Alternatively or additionally, however, the gas flow may be conducted through one or through both edge zones between the channel bottom and the channel wall. It is also possible that the channel bottom is physically not present, but that rather between the channel walls towards the axis of rotation solely an opening slot is formed, which corresponds with at least one passage in the gas supply line. In a preferred embodiment of the invention the channel walls, for example, are replaced by two wire rails, i.e., thin rails or wires, with round or rectangular cross section. With this also the opening channel as a whole is solely formed by wire rails.

The opening device preferably comprises a rotating body with an axis of rotation, around which the rotating body is conducted capable of rotating. The opening channel now as part of this rotating body in preference is formed as rotating around the rotating axis like a spiral and correspondingly also arranged as capable of rotating around this axis of rotation. The axis of rotation in preference is aligned horizontally. In doing so, that opening channel on one side is open radially towards the outside, i.e., against the axis of rotation and preferably is limited towards the axis of rotation by the channel bottom. The rotating body with the spiral-shaped opening channel functionally seen in doing so forms a kind of conveyor helix. The rotating body may be designed, e.g., a drum-, resp., cylinder-shaped or as conical.

The opening device, resp., its rotating body now in preference at, as seen in conveying direction front end, comprises a channel inlet wall also conducted rotatable around the axis of rotation The printed product seen here in conveying direction F with the correspondingly free edge zone is conducted to the opening device and during continued conveyance lays itself against the channel inlet wall with the corresponding edge zone. The mentioned edge zone now by the rotating movement of the rotating body is introduced sliding into the opening channel along the channel inlet wall, wherein the channel inlet wall passes over into a channel wall of the opening channel. During the continued guiding of the edge zone in the opening channel rotating screw-like around the axis of rotation the edge zone is fanned open by a gas flow produced through the channel bottom. Because the rotating opening channel makes a helical movement, the mentioned edge zone in the opening channel is conducted in conveying direction synchronous with the conveying movement of the transport grippers.

The opening element is preferably also arranged on the rotating body of the opening device. The opening element may be arranged in the opening channel itself or somewhat radially outside the opening channel. The opening element over and above viewed in the conveying direction in preference is arranged at the rear end of the opening channel or immediately outside the opening channel at the rear end of the rotating body. The opening element is arranged in a zone, in which the gas flow acts on the edge zone.

The rotating body of the opening device may be arranged laterally to the printed products, so that an edge zone of the printed product is conducted in the opening channel. It is also possible, however, that the rotating body is underneath the printed product, so that the front edge zones of the printed products are conducted in the opening channel. Correspondingly the opening device may also be arranged in a lower edge zone of the printed product, so that a corner zone formed by a sheet edge zone and the front edge zone is conducted in the opening channel.

In principle it is also possible, that the opening device comprises several opening elements, so that the printed product is able to be opened several times. This signifies, the opening elements separate the printed product into more than two product parts with respectively at least one sheet. The printed product is capable of being opened in the middle, i.e., both product parts respectively comprise a similar number of sheets. It is also possible, however, that it is provided that the printed product does not have to be opened in the middle. Thus, the printed product may also be opened in an approximate sheet number ratio between the two product parts, e.g, approx. ⅓ to/3 or approx. ¼ to ¾. For this purpose it may also be provided, that the opening device for the simple opening of the printed product comprises several opening elements, and that a first opening element parts the printed product into two product parts, and that a second opening element once again parts the one product part into two product parts, etc., until the correct, approximate sheet number ratio between the first and the second product part is reached. It may also be provided, that two or more opening elements simultaneously or one after the other are introduced into the fanned open printed product and that the printed product is opened into several product parts.

In a further development of the invention in the conveying direction following the opening device and underneath the conveying device a holding open device is arranged. In doing so, the opened edge zone of the printed product at the end of the channel when running out of it is passed over to the in conveying direction following holding open device. The holding open device serves to hold the opened printed product during its further conveyance in conveying direction F until it is passed over to a further processing unit. A further processing unit of this kind may, e.g., be an inserting device or may be, e.g., saddle-shaped supports of a carrying together device, on which the opened printed products are deposited.

The holding open device, in preference, comprises a holding open element, which in the transfer zone between the opening device and the holding open device runs in, resp., pricks into it. The holding open device preferably is a helix conducted rotatably, wherein the individual helix loops of the helix reach between the product parts. The helix rotated around the rotating axis carries out a helical movement and with this assists the conduction of the free edge zone in conveying direction F. The rotation of both the helical opening channel as well as of the helix is synchronised with the conveying speed of the transport grippers, so that the edge zones of the printed products conducted in the opening channel, resp., through the helix loops are moved in a conveying direction in synchronous cycle speed with the fixed edges held by the transport grippers. The rotating body of the opening device and the helix of the holding open device in preference rotate contra-rotating. The rotating body of the opening device and the helix are driven controlled by corresponding drive means and control means.

The means for producing a gas flow advantageously comprise a gas supply line running in the direction of the rotating axis. The gas supply line preferably is located in the rotating axis of the rotating body and coaxial to it. The gas supply line in preference is not held as rotatable, while the rotating body by a corresponding bearing support is supported as rotatable. The gas flow now preferably is conducted radially outward into the opening channel through corresponding outlets. The axial gas supply line for this purpose expediently comprises at least one lateral opening, wherein:

A. The gas supply line forms a tubular chamber surrounding the rotating body and the at least one lateral opening on the external circumference of the tubular chamber through a ring-shaped slot corresponds with at least one passage in the opening channel, in particular in the channel bottom;

B. the at least one opening in the gas supply line leads into a ring-shaped chamber arranged at the external circumference of the gas supply line, wherein from the chamber at least one passage leads into the opening channel, in preference through the channel bottom; or C. the gas supply line forms a tubular chamber, and the at least one lateral opening corresponds to the at least one passage in the opening channel, in particular in the channel bottom.

The tubular chamber may be a sole, interconnected chamber. Furthermore, the chamber by connection bridges may also be divided into individual, or communicating with one another, ring sectors. In principle it is also possible for gas supply lines radially branching off from the axial gas supply line to be provided, which lead into the opening channel, in particular in the channel bottom.

The variants A and B have the advantage, that in the ring-shaped chamber, resp., in the tubular chamber, it is possible to build-up a uniform pressure, so that the gas supply to the opening channel is regular.

In accordance with a further development of the device according to the invention, in a conveying direction ahead of the opening device and underneath the conveying device a supporting device is arranged. The supporting device comprises a supporting belt circulation in the conveying direction S for supporting and carrying with it the fed-in printed products in conveying direction F at their edge zone opposite the fixed edge bent forwards, front edge zone. The supporting belt in the support zone continuously moves in conveying direction F with the transport elements. The supporting belt may move at the same speed or a bit faster than the transport grippers of the transport arrangement. The supporting belt may comprise guide cogs, resp., the supporting device may comprise cogs running together with the supporting belt, to which the front edge zone of the printed products is aligned. The guide cogs move in synchronous cycle with the transport grippers or else a bit faster. The supporting arrangement gives the front edge zones bent forwards a defined position, stabilised by the bending of the printed products and keeps these at a safe distance from one another.

If in the opening channel of the opening device a free side edge zone of the printed product is conducted, then the supporting device with the supporting belt is expediently arranged laterally from the opening device, resp., from its rotating body and offset to it. In this case, the supporting arrangement and rotating body are also able to comprise a laterally overlapping zone. I.e., the printed product introduced into the opening channel in the overlapping zone simultaneously is supported by the supporting belt.

If in the opening channel of the opening device the front edge zone of the printed product is conducted, then the supporting arrangement expediently together with the supporting belt in a conveying direction is arranged directly ahead of the opening device, resp., ahead of its rotating body.

Further preferred embodiments follow from the dependent claims. In this, characteristics of the process claims in analogy are combinable with the device claims and vice versa.

The present invention in comparison with conventional devices and in particular in comparison with the solution described in the patent EP-B-0 577 964 has the advantage, that the printed products during their conveyance over several conveying cycles are opened accompanied. As a result of this, more action time for opening the product is gained, which in turn enables a more precise and gentle opening of the printed products. Instead of the increasing of the action time, it is also possible to increase the conveying speed, which in turn leads to a higher processing capacity.

The present invention furthermore also enables the gentle opening of printed products, the main surfaces of which are oriented transverse to the conveying direction, which with the device according as to EP-B-0 577 964 is not possible.

BRIEF DESCRIPTION OF THE DRAWINGS

In the following the object of the invention is explained in more detail on the basis of preferred examples of embodiments, which are represented in the attached drawings. These respectively schematically illustrate.

The reference marks utilised in the drawings and their significance are listed in summary in the list of reference marks. On principle in the Figures the same parts are indicated with the same reference marks.

DETAILED DESCRIPTION OF THE INVENTION

Figure 1:
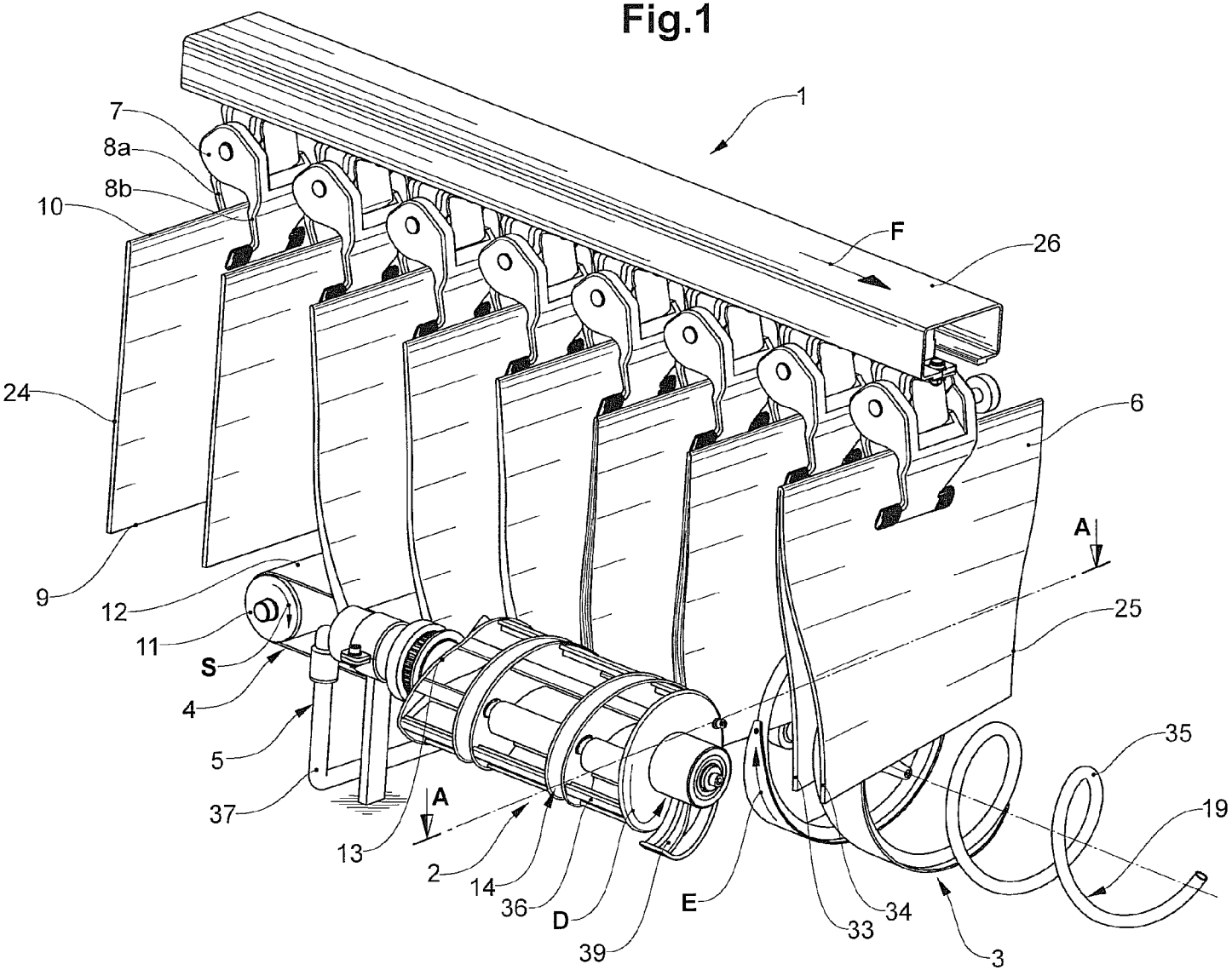
FIG. 1: A perspective view of a device in accordance with the invention for opening printed products.

FIG. 1 illustrates a preferred embodiment of the device in accordance with the invention. This comprises a transport device 1 with a conveying chain conducted in a conveying rail (not shown). The conveying chain comprises a plurality of transport grippers 7 arranged one behind the other at regular distances, which respectively hold by clamping at least one printed product 6 clamped over the fixed edge 10. The transport grippers 7 respectively comprise two clamping jaws 8*a*, 8*b*, which are movable relative to one another from an opening—into a closing position and vice versa, which clamp the printed product 6 in the closing position. The transport grippers 7 are held on the conveying chain, which moves these in a conveying direction F.

The printed products 6 respectively are held suspended over their fixed edge 10 extending transverse to the conveying direction. The printed product 6 respectively comprises at least two, in preference more than two sheets, resp., pages, which are held together over the fixed edge 10. The printed product 6 furthermore comprises a first and a second page edge zone 24, 25 as well as a front edge zone 9 located opposite the fixed edge 10.

The device furthermore comprises a supporting arrangement 4 arranged underneath the conveying device 1 with a supporting belt 12 circulating around deflection rollers. The supporting belt 12 forms a supporting surface for the front edge zones 9 located opposite the fixed edge 10. The supporting belt 12 is moved in the supporting surface in the conveying direction F and serves to support and conduct the front edge zone 9 of the of the fed-in printed products 6 in conveying direction F. This takes place, in that the supporting belt 12 relative to the printed products 6 is arranged and moved in such a manner, that the front edge zone 9 of the respective printed product 6 lies against—resp., on the supporting belt 12 and is bent forwards in the conveying direction F.

The printed product 6 with the stabilised and from the neighbouring printed products 6 at a safe distance, forward edge, is conveyed to, resp., passed over to a following in conveying direction F opening device 2. The opening device 2 is also arranged below the transport device 1 and laterally to the printed products 6. The opening device 2 rotatable around a rotating axis 29 in rotating direction D comprises a rotating body 36. Arranged around the mentioned rotating axis 29 (see also FIG. 2) is a helical opening channel 14. The opening channel 14 comprises two channel walls 22*a*, 22*b* at a distance from one another between which a channel bottom 27 is arranged. The opening channel 14 is radially open to the outside and towards the rotating axis 29 bordered by the channel bottom 27. The rotating body 36 viewed in conveying direction F ahead of the opening channel 14 comprises a channel inlet wall 13, to which the corresponding side edge zone 24 of the printed product 6 coming from the supporting device 4 is conducted. By the rotating movement of the rotating body 36 and therefore also of the channel inlet wall 13 and the opening channel 14 the side edge zone 24 is inserted into the opening channel 14. The rotating body 36 hereby respectively screws itself between two suspended printed products 6, so that the printed products 6, respectively, their free side edge zones 24 are conducted in the opening channel 14.

In doing so, the channel inlet wall 13 merges into a side wall 22*a*, 22*b* of the opening channel. Because the opening channel is constructed as helical, the side edge zone 24 is conducted along in conveying direction F in the rotating opening channel 14.

The opening device 2 furthermore comprises blast air supply means 5, through which blast air 21 is supplied into the opening and end channel 14. The blast air 21 for this purpose is supplied to the rotating body 36 through an external blast air line 37, which merges into an axial blast air supply line 28 located in the rotating axis 29 of the rotating body 36. The axial blast air supply line 28 comprises an end section in the form of a tubular blast air chamber 47. The tubular blast air chamber 47 comprises one or several axially aligned slot openings 30, through which the blast air is conducted to the opening channel. The channel bottom 27 of the opening channel 14 also comprises one or several blast air passages 20, through which the blast air 21 supplied through the slot opening 30 is supplied to the opening channel 14. Between the channel bottom 27, resp., the rotating body 36 and slot opening 30, resp., the tubular blast air chamber 47 a ring-shaped slot is formed 31. This is necessary, because the rotating body 36 with the opening channel 14 rotates relative to the tubular blast air chamber 47. The slot opening 30 and the at least one blast air passage 20 in the channel bottom 27 overlap one another in at least one surface section, in which the blast air 21 from the blast air chamber 47 is able to flow into the opening channel 14.

The rotating body 36 with the opening channel 14 is supported rotatable around a rigidly supported basic body, containing the blast air supply line 28 with the tubular blast air chamber 47. The slot opening 30 of the tubular blast air chamber 47 and the blast air passages 20 of the rotatably conducted channel bottom 27 move relative to one another when the rotating body is rotated. If the blast air passage 20 now is a slot opening arranged in a longitudinal direction of the opening channel 14 in the channel bottom 27, then a continuous blast air flow 21 is produced, which by the rotating movement of the helical opening channel 14 moves in the conveying direction together with the printed product 6. If the blast air passages 20 are rows of holes in the channel bottom 27 along the opening channel 14, then a modulated blast air flow 21 acts on the moving printed product 6.

The blast air therefore radially flows out of the channel bottom 27 and parallel to the sheet surfaces of the printed product between the individual sheets and fans these open. The air cushions formed by the blast air 21 between the sheets 18 lead to a thickening of the printed product 6 in the conducted side edge zone 24, which now fills the whole channel width.

The rotating body 36 furthermore comprises an opening element in the form of an opening wedge 15 arranged in the opening channel 14, which correspondingly rotates together with the rotating body and by this rotating movement runs in between the sheets 18 of the fanned-open side edge zone 24 and opens it, as soon as the printed product 6 conveyed in the conveying direction F arrives at the location of the opening wedge 15. The opened printed product 6 now comprises a first and a second product part 33, 34, which respectively comprises a plurality of sheets 18. The opened printed product 6 subsequently is conducted out of the opening channel 14, wherein a holding open element 39 also arranged on the rotating body ensures, that the printed product 6 remains opened.

Following the rotating body 36, resp., the opening device 2 is a holding open device 3 in the form of a helical screw 19 rotatable in rotating direction E around a rotating axis. The helical screw 19 is arranged laterally offset from the rotating body 36 and synchronised with it in such a manner, that a holding open wedge 23 on the helical screw 19 stabs into the opened printed product 6, before it completely leaves the rotating body 36, resp., the helical opening channel 14 and with this the holding open element 39. The opened printed product 6 in opened position is further accompanied by the rotating helical screw 19 in conveying direction F, and in doing so held opened.

The printed products 6 during the opening process described above are continuously conveyed onwards by the transport arrangement 1, wherein the helical execution of the opening channel 14 as well as the helical execution of the holding open device 19 by their helical rotating movement assure, that the printed product also at its edge zone 24 in the opening channel 14, resp., in the helical screw is conducted onwards in the conveying direction. The rotating speed of the rotating body 36 and of the helical screw 19 is in dependence of the inclination of the helix of the described elements 14, 19 synchronised to the conveying speed of the transport device 1. In this manner, the products during their conveyance are able to be opened in a continuous process, as a result of which more time is available for opening the printed products or as a result of which the conveying speed is able to be increased. Because the opening process takes place during the conveyance, it must not, resp., the individual operations of the opening process, such as, e.g., the fanning open of the edge zone or the introduction of the opening wedge between the sheets may also require more time, which in turn improves the process security, the process stability and the quality.

Figure 2:
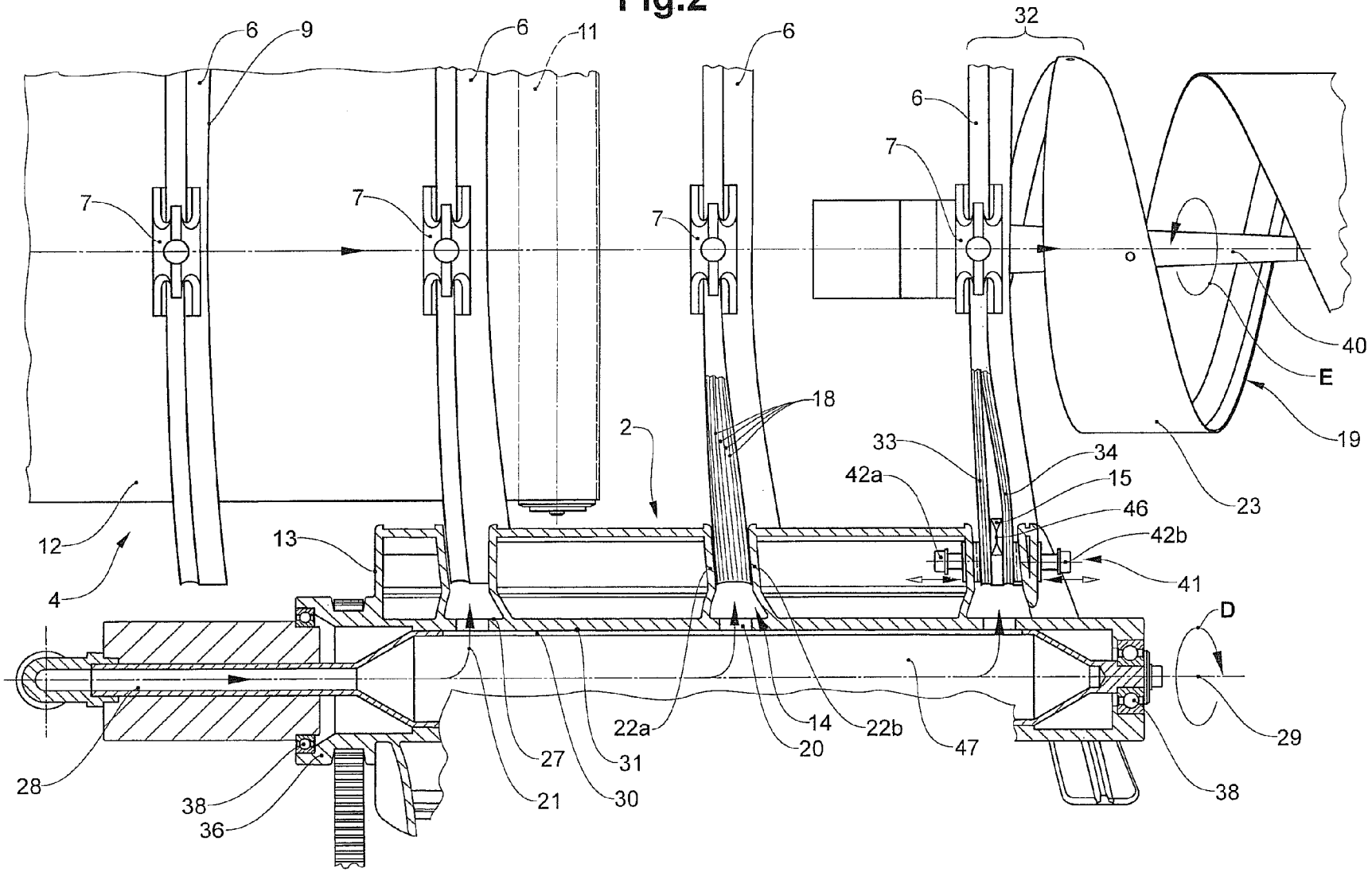
FIG. 2: a cross-section view through a device in accordance with the invention according to FIG. 1.
Figure 3:
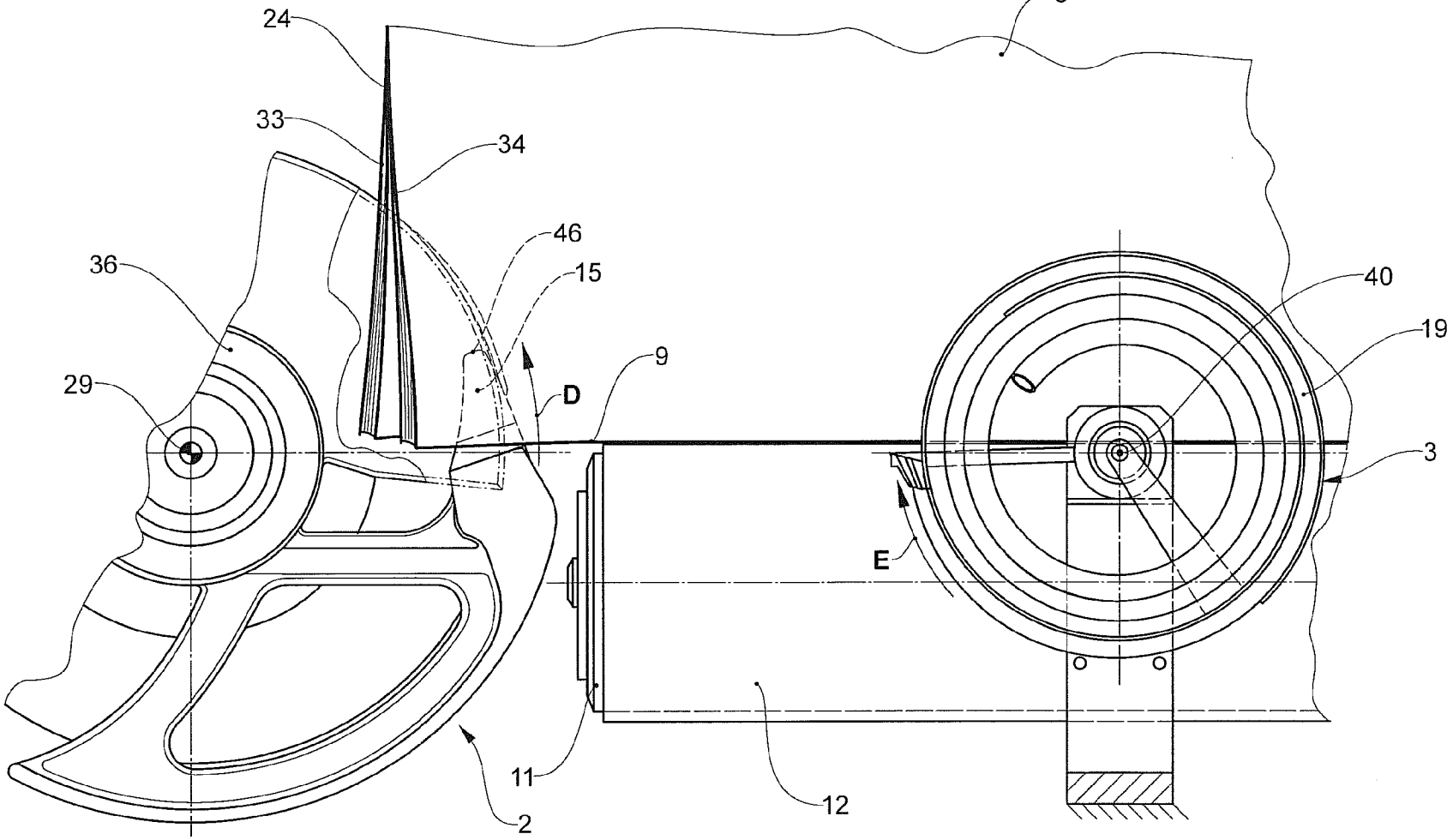
FIG. 3: a cross-section view through the opening device along the line A-A according to FIG. 1.

From the FIGS. 1 to 3 it is also apparent, that a supporting device 4 with its supporting belt 12 circulation around a front deflection roller 11 is arranged laterally offset ahead of the opening device 2, resp., in front of its rotating body 36. The supporting belt 12 supports the front edge zone 9 in the already described manner during the time the opening channel 14 of the rotating body 36 guides a first edge zone 24 of the printed product 6. In an overlapping zone between the rotating body 36 and the supporting device 4 the printed product 6 is supported both with its front edge zone 9 by the supporting belt 12 as well as conducted through the opening channel 14 with its first side edge zone 24.

FIG. 3 depicts a printed product 6 in the transfer zone 32 between the opening device 2 and the holding open device 3. The printed product 6 conducted in the opening channel 14 with a free sheet edge zone 24 by the opening wedge 15 running between the sheets of the printed product through the rotating movement of the rotating body 36 is open as already described and forms a first and a second product part 33, 34. The helical screw 19 of the holding open device 3 runs into the opened printed product 6, and this before it has left the opening device 2 and with this the action zone of the opening wedge 15. For this purpose, the helical loops 35 (FIG. 1) of the helix 19 of the holding open device 3 run between the product parts 33, 34. The printed product 6 therefore only leaves the action zone of the opening wedge 15, when a first helical loop 35 has run in between the product parts 33, 34.

Figures 4, 5:
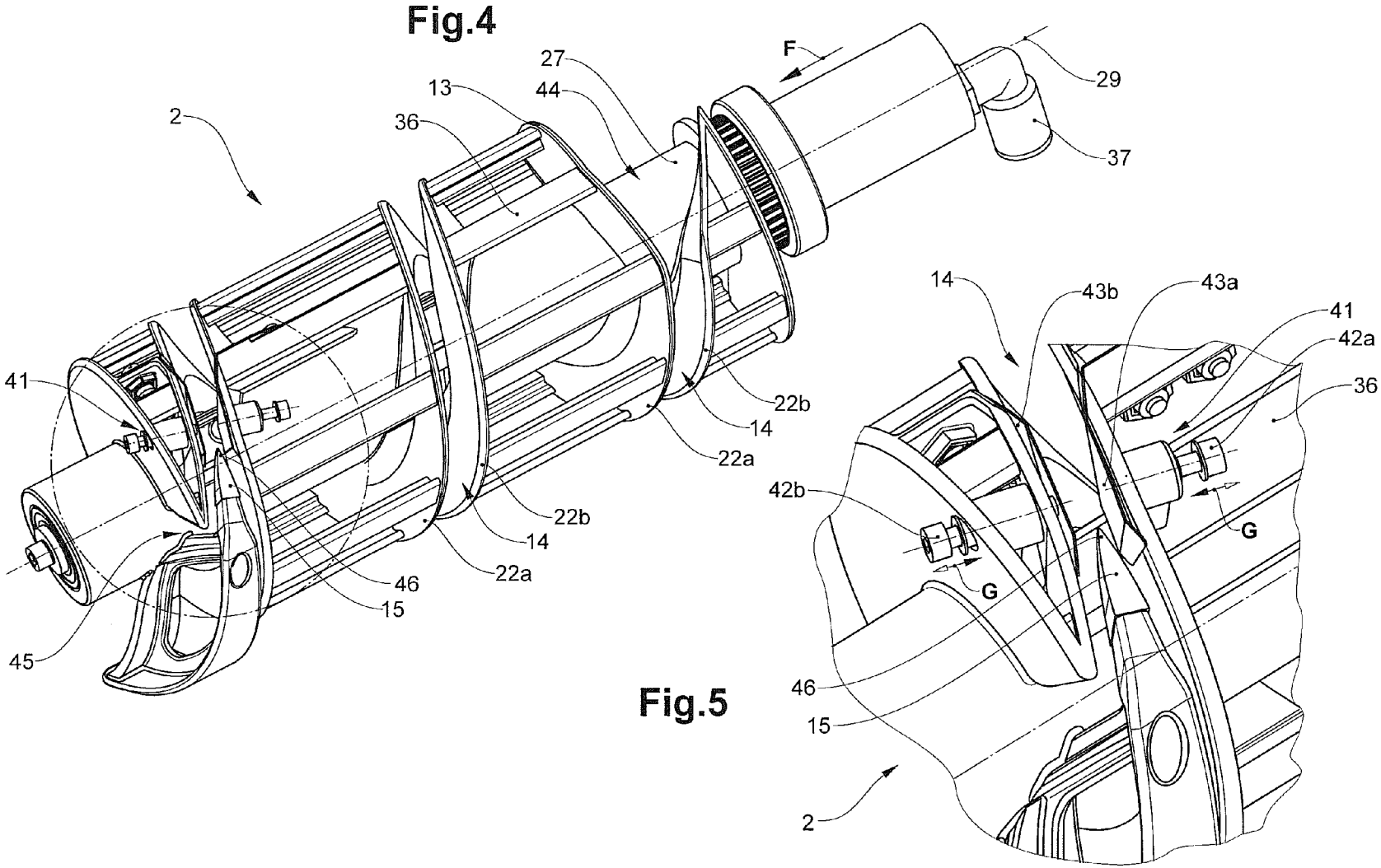
FIG. 4: a side view of the opening device.
FIG. 5: a detailed cut-out of the section opening channel of the opening device in the zone of the opening wedge according to FIG. 4.

As is particularly well apparent from FIG. 4, the opening device 2, resp., its rotating body 36 at its front end zone (viewed in conveying direction F) comprises an inlet zone 44 with a channel inlet wall 13 auf. The printed product 6 with its first sheet edge zone 24 is conducted into the inlet zone 44, which forms a funnel shaped constriction and at its narrowest point goes over into the opening channel 14. The channel inlet wall 13 in doing so forms a wall of the inlet funnel and goes over into a first channel wall 22*a*. The other wall of the inlet funnel goes over into the second channel wall 22*b*. The opening channel 14 conducted helically around the rotating body 36 towards the end of the rotating body (viewed in conveying direction F) comprises a run-out zone 45 auf, at which the first sheet edge zone 24 of the printed product 6 leaves the opening channel 14 again. Before running out of the opening channel 14, i.e., in the vicinity of the running out zone 45, the opening wedge 15 is arranged, which separates the fanned open printed product 6 into two product parts 33, 34 (see also FIG. 5).

As from FIG. 5 particularly well apparent, ahead of the opening wedge (viewed in conveying direction F) a spacing control device 41 is arranged. This comprises first and second spacing battens 43*a*, 43*b* arranged in the opening channel and with a distance between one another The spacing battens 43*a*, 43*b* are laterally arranged on the channel walls 22*a*, 22*b* and serve for adjusting the channel width, i.e., in particular of the narrowing of the opening channel 14 before the opening of the printed product 6. The spacing battens 43*a*, 43*b* therefore extend up to the front edge 46 of the opening wedge 15 and if so required, beyond it.

For adjusting the channel width adjusting elements 42*a*, 42*b* are provided, by means of which the position of the spacing battens 43*a*, 43*b* is capable of being adjusted transverse to the channel walls 22*a*, 22*b* (direction G) and relative to one another, resp., relative to the channel walls 22*a*, 22*b*. In this manner it is possible to vary the width of the opening channel 14 and narrowed in particular towards the opening wedge 15. The spacing control device 41 serves to adapt the opening device 2 to differing thicknesses of the printed products 6, i.e., to printed products 6 with differing numbers of sheets, resp., pages. The more sheets a printed product comprises, the wider the opening channel 14 ahead of the opening wedge 15 is. The less sheets, resp., pages the printed product 6 comprises, the narrower the channel ahead of the opening wedge is.

The spacing battens 43*a*, 43*b* may, as shown here, be provided additionally to the channel walls 22*a*, 22*b*. They may, however, also be designed as movable parts of the channel walls 22*a*, 22*b* themselves (not depicted). The adjusting elements may, for example, comprise adjusting screws 42*a*, 42*b*, by means of which the spacing battens 43*a*, 43*b* or the channel walls 22*a*, 22*b* are variable for the adjustment of the channel width. Furthermore it is possible that the spacing battens 43*a*, 43*b* are adjusted electrically by control elements (not depicted).

Figure 6:
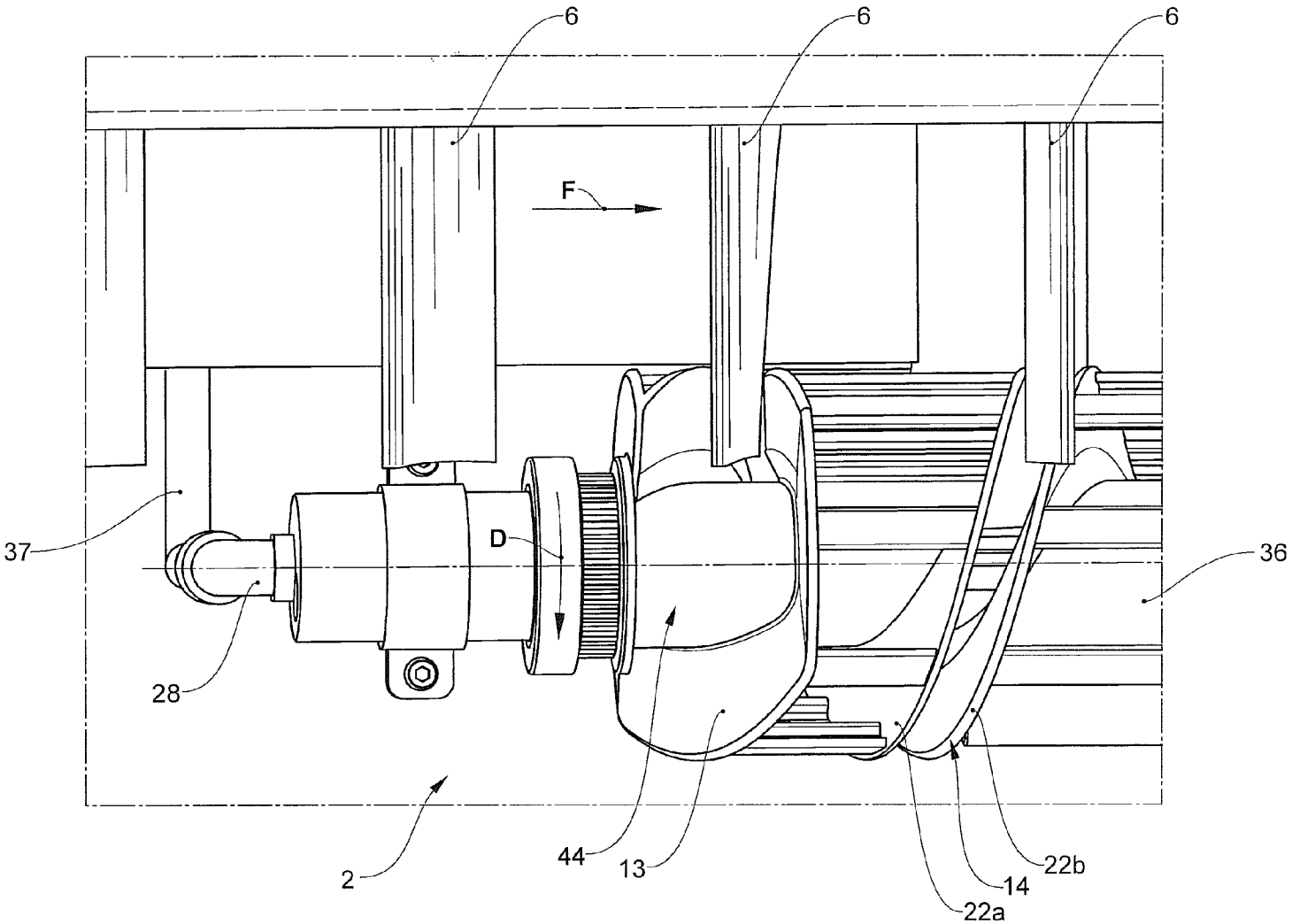
FIG. 6: a detailed cut-out of the opening channel of the opening device in the zone of the channel inlet wall.

FIG. 6 indicates an enlarged section of the funnel shaped inlet zone 44 in accordance with FIG. 4, which passes over into the helically designed opening channel 14 with the opening channels 22*a*, 22*b* following it.

It goes without saying, that the embodiments illustrated in the FIGS. 1 to 6 are also suitable for conducting, fanning open and opening the front edge zone 9 of the printed product 6 instead of the free page edge zones 24, 25. Furthermore the term "blast air" utilised in the illustrated embodiments shall quite generally signify a gas flow.

The invention claimed is:

1. A device for opening and transporting on of printed products (6) with respectively at least two sheets (18) held together over a fixed edge (10), comprising a conveying device (1) with transport grippers (7) driven in a conveying direction (F), arranged at a distance behind one another with a spacing between one another, which are designed to hold the printed products (6) suspended by their fixed edge (10), as well as comprising an opening device (2) arranged below the conveying device (1), which is intended to open the printed products (6), wherein the opening device comprises gas supply means (5) for producing a gas flow (21), by means of which the sheets (18) of the printed product (6) are able to be fanned open in a free edge zone (24), as well as an opening element (15) capable of being introduced into the fanned open, free edge zone of the printed product (6), characterised in that the opening device (2) comprises an helical opening channel (14) rotatable around a rotating axis (29) for conducting the free edge zone (24), and in the opening channel (14) through the gas supply means (5) gas flows (21) capable of acting on the edge zone (24).

2. A device according to claim 1, wherein the opening channel (14) comprises two lateral channel walls (22*a*, 22*b*) with a distance between one another, wherein the gas flows (21) are able to be supplied into the opening channel (14) through opening passages (20).

3. A device according to one of the claims 1 to 2, wherein the opening passages (20) comprise one or several rows of holes and/or opening slots arranged along the opening channel (14).

4. A device according to one of the claims 1 to 3, wherein the opening channel (14) is radially open to the outside.

5. A device according to one of the claims 1 to 4, wherein the opening device (2) comprises a supply line (28) for the gas flows (21) extending in the direction of the rotating axis (29) and in preference lying in the rotating axis (29), and the supply line (28) comprises at least one lateral slot (30), and the opening channel (14) between the channel walls (22*a*, 22*b*) comprises at least one passage (20), and the at slot (30) of the supply line (28) and the at least one passage (20) between the channel walls (22*a*, 22*b*) overlap one another in at least one surface area zone, in which the gas flows (21) from the supply line (28) are able to flow into the opening channel (14).

6. A device according to one of the claims 1 to 5, wherein the opening device (2) comprises means for adjusting the width of the opening channel (14) for the purpose of adapting the channel width to the thickness of the printed product (6) and/or for the purpose of adjusting the sheet spacing of the fanned open, free edge zone (24).

7. A device according to one of the claims 1 to 6, wherein the gas required for producing the gas flows (21) in the opening channel (14) is capable of being supplied through a supply line (28) extending in axial direction, preferably in the rotating axis (29) and through corresponding passages (20, 30) capable of being supplied radially outwards into the opening channel (14).

8. A method for opening printed products (6) by means of a device according to one of the claims 1 to 7, with the steps:

transportation of printed products (6) with a conveying device (1) with transport grippers (7) driven in conveying direction (F), arranged at a distance behind one another, wherein the transport grippers (7) hold the printed products (6) suspended on a fixed edge (10);

introduction of a free edge zone (24) of the printed products (6) into an opening channel (14);

fanning open the sheets in the free edge zone (24) by means of gas flows (21) acting in the opening channel (14) (21);

opening of the printed product (6) by the penetration of an opening element (15) between the fanned open sheets (18);

characterised in that the printed product (6) with continuous conveyance viewed in conveying direction (F) with its free edge zone (24) is introduced into a helical opening channel (14), and the free edge zone (24) is guided by the helically rotating opening channel (14) during the onward conveyance of the printed product (6).

9. A method according to claim 8, wherein the free edge zone (24) of the printed product (6) during the conveyance is laterally guided by at least one channel wall (22*a*, 22*b*) of the opening channel (14), and the free edge zone (24) by the gas flow (21) is fanned open over the width of the opening channel (H), wherein the channel walls (22*a*, 22*b*) serve as limiting means.

10. A method according to claim 8 or 9, wherein the printed product (6) in the opening channel (14) is fanned open and subsequently by an opening element (15) inserted into the fanned open zone is separated into at least two product parts (33. 34) with respectively at least one sheet (18).

11. A method according to one of the claims 8 to 10, wherein the opened printed product (6) at the end of the opening channel (14) when running out of the helical opening channel (14) is transferred to a holding open device (3).

12. A method according to one of the claims 8 to 11, wherein the opened, free edge zones (24) of the printed products (6) are taken over from the opening device (2) and held open by a holding open device (3) following the opening device (2) in conveying direction (F), wherein in the transfer zone (32) a holding open element (23) attached to the holding open device (3) penetrates between the product parts (33, 34) of the opened printed product (6) and during a transition phase the opening element (15) and the holding open element (23) simultaneously engage in opened, free page edge zones (24).

13. A method according to on of the claims 8 to 12, wherein the gas flow (21) acting in the opening channel (14) for fanning open the free edge zone (24) along and/or across the width of the opening channel is modulated in its strength and/or in its direction of flow.

14. An opening device (2) for opening printed products (6) for utilisation in a device according to one of the claims 1 to 7, wherein the opening device (2) comprises gas supply means (5) for producing a gas flow (21), by means of which the sheets (18) of the printed product (6) are able to be fanned open in a free edge zone (24), as well as an opening element (15) capable of being inserted into the fanned open, free edge zone (24) of the printed product (6) between the sheets (18), characterised in that the opening device (2) comprises a rotatable around a rotating axis (29), helical opening channel (14) for guiding the free edge zone (24) of the printed product (6), and in the opening channel (14) through the gas supply means (5) gas flows (21) are capable of acting on the edge zone (24).

* * * * *